US007381913B2

(12) United States Patent
Sjostrom

(10) Patent No.: US 7,381,913 B2
(45) Date of Patent: Jun. 3, 2008

(54) SWITCH ELEMENT

(76) Inventor: Philip Adrian Sjostrom, 12 Krieg Street, Nuriootpa, 5355 (AU)

( * ) Notice: Subject to any disclaimer, the term of this patent is extended or adjusted under 35 U.S.C. 154(b) by 70 days.

(21) Appl. No.: 10/578,393

(22) PCT Filed: Nov. 5, 2004

(86) PCT No.: PCT/AU2004/001525

§ 371 (c)(1),
(2), (4) Date: May 5, 2006

(87) PCT Pub. No.: WO2005/045867

PCT Pub. Date: May 19, 2005

(65) Prior Publication Data

US 2007/0039812 A1 Feb. 22, 2007

(30) Foreign Application Priority Data

Nov. 6, 2003 (AU) ..... 2003906115

(51) Int. Cl.
*H01H 9/26* (2006.01)

(52) U.S. Cl. ..... 200/5 A; 200/512

(58) Field of Classification Search ..... 200/6 BB, 200/6 C, 532, 512–517, 535
See application file for complete search history.

(56) References Cited

U.S. PATENT DOCUMENTS 4,476,355 A * 10/1984 Mital ..... 200/5 A
4,778,952 A 10/1988 Watkins et al.
4,864,085 A * 9/1989 Hanajima et al. ..... 200/5 A
5,146,054 A * 9/1992 Etters ..... 200/85 A
6,262,646 B1 7/2001 Van Zeeland
6,423,918 B1 7/2002 King et al.
6,542,058 B2 4/2003 Van Zeeland
6,552,287 B2 * 4/2003 Janniere ..... 200/406
7,070,349 B2 * 7/2006 Dombrowski et al. ..... 400/490
2005/0224330 A1 * 10/2005 Liu et al. ..... 200/345

FOREIGN PATENT DOCUMENTS

JP 2000-57885 2/2000
WO WO02/089162 11/2002

* cited by examiner

*Primary Examiner*—Elvin Enad
*Assistant Examiner*—Lisa Klaus
(74) *Attorney, Agent, or Firm*—Klauber & Jackson LLC

(57) ABSTRACT

A switch element for surface mounting onto a printed circuit board which has a bearer element (2) and a contact element (1). Both the bearer element and the contact element are formed from an electrically conductive material and the contact element being formed from a resilient material. The bearer element and the contact element can be of an integral construction or are separate components assembled together. By this construction the bearer element comprises a peripheral retainer for the contact element. In one arrangement the bearer element has an inwardly facing C-shaped cross sectional shape to provide a recess to act as a peripheral retainer for the contact element by receiving at least a portion of the rim of the contact element in the C-shaped member recess.

11 Claims, 10 Drawing Sheets

SWITCH ELEMENT

CROSS REFERENCE TO RELATED APPLICATIONS

The present application is a National Stage Application claiming the priority of co-pending PCT Application No. PCT/AU2004/001525 filed Nov. 5, 2004, which in turn, claims priority from Australian Provisional Patent Application Serial No. 2003906115 filed Nov. 6, 2003. Applicants claim the benefits of 35 U.S.C. § 120 as to the PCT application and priority under 35 U.S.C. § 119 as to the said Australian application, and the entire disclosures of both applications are incorporated herein by reference in their entireties.

FIELD OF INVENTION

This invention relates to a switch element and more particularly to a switch element which can be mounted onto a printed circuit board as a surface mounting component.

BACKGROUND OF THE INVENTION

Switches can be used upon a substrate such as a printed circuit board (PCB), or a similar rigid or flexible substrate which features appropriate conductive pads and tracks upon its surface. When combined with the conductive pads and connecting tracks of the substrate, the switch is able to operate as an electrical switch which may be connected to an associated electrical circuit. Such an associated circuit will generally be some type of system incorporating electronic logic functions. Such an associated circuit might be a device which incorporates discreet electronic logic components or a micro-controller to interpret and act in accordance with, the signals conveyed from a key-pad.

Such applications are presently served by devices commonly known as dome-switches, or simply as domes. These devices are made as a domed element, with a round or other derived shape from conductive sheet material, generally a very thin, resilient metal with spring properties which cause it to return to its formed shape when any actuating forces are released. High volumes of domes are widely used in electronics industries in conjunction with a range of various ancillary applied materials and systems, the essential purpose of which is to contain and retain the domed contact elements, stationed upon printed-circuit substrate materials.

In contemporary laminated key-panels, the shape of the domed element used serves two purposes:

First, the central portion of the domed element, in its relaxed or un-actuated state, is raised above the plane of the element's rim, ensuring that the central portion is poised above, yet electrically isolated from, a contact surface below the dome. This contact surface is generally provided on some type of printed circuit board which acts as a substrate upon which the dome is positioned to form an electrical switch. The clearance between these two elements is generally about one or two millimetres. The rim of the dome, when not actuated by a force which would distort its shape, is the only part of the unit which is in contact with an associated substrate, such as a PCB. Upon such a PCB is a conductive pad, generally in the form of a full or partial annular ring, upon which the dome's rim sits, being electrically in contact with it. This rim-contact pad is electrically isolated from a centralised contact pad which forms the second node of a simple switch, with the contacting element being the dome itself.

Second, the shape of the dome and the springy nature of the sheet material from which it is formed means that, when the dome's central portion is depressed (by a finger), it can be caused to deform in a sudden or "snap" action. The element, partly "flattened" in this way, can be made to electrically connect the inner and outer contact-pads upon a substrate such as a PCB. As this actuating pressure is steadily released, the domed element, due to the effects of its mechanical hysteresis will delay its return to its normal, un-actuated state, until it suddenly releases with a "snap-action". This snap-action serves the very important function of providing tactile feedback to a human operator of the key-panel switch, ie; it signals to the operator the impression that a switching action has indeed occurred. This hysteresis also serves as a contact de-bounce mechanism, although this is not crucial these days because micro-controller programs, as commonly seen in situations using dome-switch key-pad fabrications, can easily ignore the effects of contact-bounce.

These dome can have problems of migration especially when used in a vertical position and the edges of the dome can wear away the conductive track on the PCB and so cause failure of the switching function.

It is an object of this invention to provide an alternative switch element suitable for surface mounting onto a PCB or to at least provide a useful alternative.

BRIEF DESCRIPTION OF THE INVENTION

In one form the invention is said to reside in a switch element for surface mounting onto a printed circuit board, the switch element having a bearer element and a contact element, both the bearer element and the contact element being formed from an electrically conductive material and the contact element being formed from a resilient material.

In one embodiment the bearer element and the contact element may be of an integral, construction.

Alternatively and preferably the bearer element and the contact element are separate components assembled together.

Preferably the contact element is a shallow dome shape and may include legs extending therefrom.

The contact element may be provided with at least one or more formed contact points close to the centre of the dome which would reduce dome travel to prevent over extension of the dome and improve contact characteristics between the dome and pads or tracks on the printed circuit board or other substrate with conductive tracks. The device may be connected to external electrical or electronic circuits via conductive tracks on both or one side of the printed circuit substrate, which may feature conductive, plated-through holes to connect tracks from one side to the other.

Preferably the bearer element is a peripheral retainer and bed for the contact element which is held captive therein.

Preferably the bearer element has an inwardly facing C-shaped cross sectional shape to provide a recess to act as the peripheral retainer for the contact element by receiving at least a portion of the rim of the contact element or the legs extending from the contact element in the C-shaped recess.

Preferably the bearer element has a substantially planar base to enable it to be affixed to a conductive track on a printed circuit board by solder, a conductive adhesive or a like process. A solder paste may be provided on the planar base to assist with soldering the switch element to a printed circuit board. Alternatively the solder paste may be provided onto a printed circuit board onto which the switch element may be affixed. Alternatively, the device may be fixed by direct fusion of its planar surface to the conductive surfaces of a planar substrate, by a process of electrical resistance-welding.

The inner periphery of the planar base may be provided with a slight downwards angle to contact a printed circuit board in use and form a barrier against the ingress of soldering fluxes or other residues of the fixing process onto the central region where a contact pad is located.

There may be provided on the planar base an inner periphery with a slight upturned edge.

The bearer element may include at least one bridge around its periphery to enable the bearer element to bridge tracks on the printed circuit board which it is not intended that the bearer element contact. This variant would permit use of single-sided printed circuit boards or other substrates with conductive tracks.

The bearer element may be shaped in any desirable shape such as circular, square, rectangular or triangular and the contact element received in the bearer element may be a corresponding shape either with a continuous periphery or with legs as extension of the dome shape extending into the recess of the bearer element.

One method by which the switch element may be manufactured is by forming the two components and then distorting the contact element so that its rim can be placed into the bearer element. Alternatively the bearer element can be partially fabricated into a right angled edge component, the contact element placed into it and the top edge of the bearer element rolled in to form the C-shaped recess with the contact element captured within it. Alternatively, the bearer element can be formed, from a continuous thin strip of material by pincher-rollers or similar process, into a circular form with a gap left slightly open, permitting the insertion of the contact element, the circle then being compressed until the gap is closed and the contact element is held captive upon the bed provided by the bearer element.

The bearer element maybe manufactured from a material such as tin plated high tensile steel or other suitable material. The contact element may be manufactured from steel, stainless steel or the like. Essentially, the material must be electrically conductive or have conductive surfaces which are capable of contacting and connecting, when actuated, the conductive pads and tracks on the printed circuit board or similar substrate, upon which it is to be mounted. Conductive plastics or plastics with appropriate conductive surfaces or other non-metallic, but appropriately conductive materials may be used.

The unit is nominally fabricated from two parts which, once assembled, are ordinarily inseparable.

The switch element according to the present invention generally addresses a large proportion of those applications which are presently served by laminated dome-switch fabrications, with such applications including "key-switches", "key-pads", "key-panels" or "buttons". However, the switch element also redresses a number of issues which are problematic to the use of simple "naked domes".

When the switch element is associated with a pair of conductive pads, normally electrically isolated from each other, on a substrate, a switch, capable of a momentary-action, is produced.

The switch element according to the present invention has a number of advantages over existing free dome switch components. These include:

The edges of the contact element do not bear directly onto the foil of the printed circuit board and hence there cannot be wear.

The switch element can be mounted vertically of horizontally as there is no danger of migration of the switch element as there can be with domes.

Installation without the necessity of using a spacer may give a cheaper assembly.

The bearer element provides an optimised bed for the contact element, providing consistent, stable, and secure, long-life properties which can exemplify the performance of the contact element.

Some terms used in this specification. The terms "dome", "dome-switch" and other references to domes are used generically. The term "PCB" refers to a printed circuit board, an insulating rigid or flexible substrate with conductive patterns upon it, which are commonly etched upon copper-foil laminated materials which may be rigid or flexible. Alternatively, conductive pads and traces may be formed by conductive inks printed upon flexible or rigid insulating substrates. These conductive patterns and connections commonly may be on one or both sides of the substrate, and may be connected, in the case of double-sided PCBs, from one side to the other by plated-through holes, commonly known as vias. Vias are often a feature of key-panel substrates used by existing devices and may also feature in fabrications employing the switch element. The following proposal does not dwell on the features of printed circuit board (PCB) substrates, except where such features are considered in conjunction with features of the switch element.

The term SMD refers to surface mounted devices. The switch element according to the present invention is a surface mounted device and its ability to be dispensed and installed, automatically, by existing, surface mounting technology (SMT), in the form of computer controlled "Pick and Place" machinery, can confer significant advantages. In contemporary electronics manufacturing practices, many or most components are SMDs which can be mounted on a PCB by robotic pick-and-place machines, for subsequent soldering by automated re-flow ovens. These SMD processes are standardized and can also be used to mount the switch element, simply by accommodating the device in the machine's controlling program.

BRIEF DESCRIPTION OF THE DRAWINGS

This then generally describes the invention but to assist with understanding reference will now be made to specific embodiments of the invention with reference to the accompanying drawings.

In the drawings.

DESCRIPTION OF PREFERRED EMBODIMENTS

Figure 1:
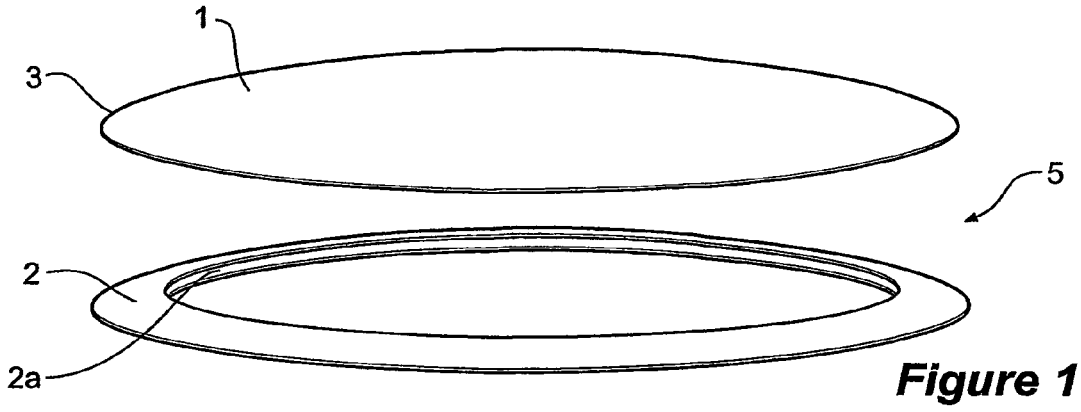
FIG. 1 shows an exploded view of the components of one embodiment of the invention.

FIG. 1 shows an exploded perspective view of a contact element 1 and an associated bearer element 2 of a switch element 5. In this example, the contact element 1 is a diaphragm in the form of a shallow metal dome.

Figure 2:
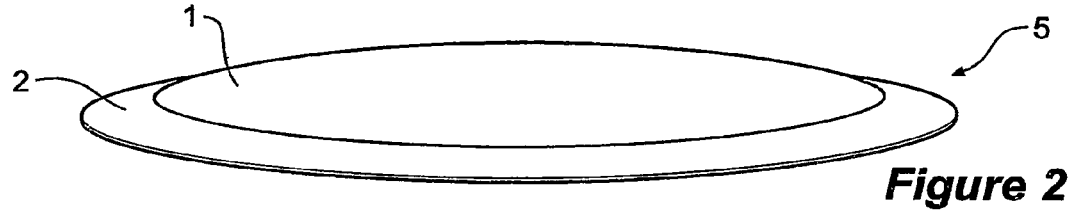
FIG. 2 shows the components of FIG. 1 in an assembled condition.

FIG. 2 shows the switch element 5 with the contact element 1 retained within the bearer element 2. The switch element, once assembled together, forms a unit, the parts of which are expected to be inseparable in all ordinary circumstances of application and operation. The diameter of the contact element is such that its rim 3 (see FIG. 1) will be held captive by the curved lip and so-formed inner surfaces of the bearer element which is in a C shape facing with its open side toward the centre of the bearer element. The rim of the diaphragm rests upon the hard inner surface of the bearer element, or may be additionally, lightly constrained by the internal "crease" formed by the retaining lip. The dimensions and profile of the diaphragm can be such that, in its un-actuated state, it will be lightly pinned by the retaining lip, to the bearing surface, below, by the formed hip of the bearer element. This is one method among several, of preventing the contact element from "rattling" inside the bearer element. Fine adjustments in design detail or dimensions of the bearer element and associated contact element may be used to exemplify selected traits of the switch element.

Figure 3:
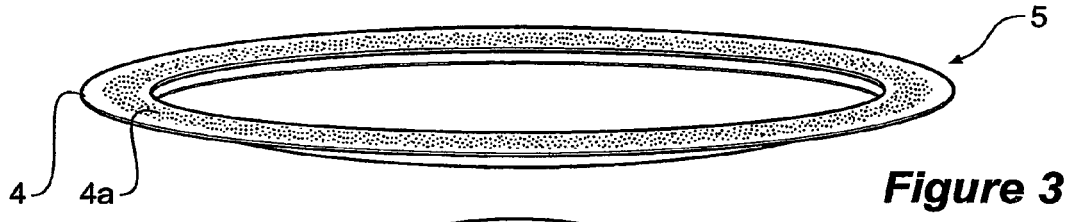
FIG. 3 shows the underside of the embodiment shown in FIG. 2.

FIG. 3 shows the switch element 5 and particularly the under-surface 4 of the bearer element 2. This under-surface 4 is plated or tinned or otherwise coated with a metal or alloy or a solder paste, to facilitate bonding to a substrate, for example, a printed circuit board (PCB), by any of a number of forms of soldering or fusion-welding processes, or by use of electrically conductive adhesive materials. Generally the area shown by the shading 4*a* can be the region that mates with a connecting surface on a printed circuit board by soldering, conductive adhesive or the like. Essentially, the switch element is a surface mounted device (SMD), which can be treated, in all respects, as any other SMD, that is, it can be placed on a PCB by existing automated pick-and-place assembly equipment for subsequent soldering by existing re-flow oven equipment. The switch element is ideally suited to these automated fabrication processes, but may alternatively be bonded to an appropriate substrate by any of several processes of fusion-welding.

Figure 4:
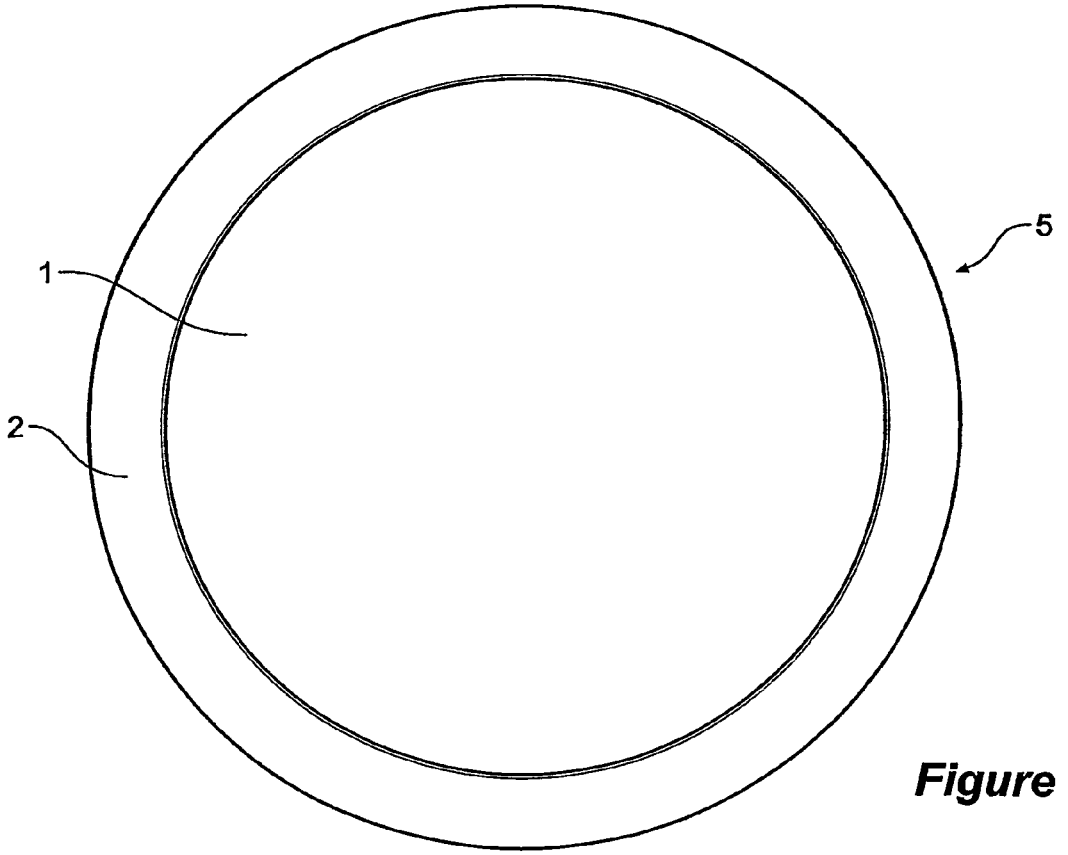
FIG. 4 shows a plan view of the embodiment shown in FIG. 2.

FIG. 4 shows a plan view of the switch element 5, magnified approximately ten times. The contact element 1 is enclosed about its rim by the bearer element 2.

Figure 5:
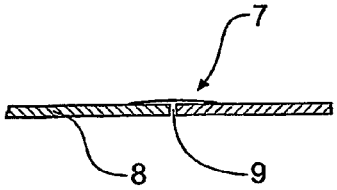
FIG. 5 shows a plan and cross sectional view of the embodiment of FIG. 2 reduced to an approximate practical actual size.

FIG. 5 shows a cross sectional view of the switch element 7, reduced to an approximate practical size and mounted upon a substrate such as a PCB 8. The device may be smaller or larger, as determined by practical requirements. The PCB has 8 a small hole 9 which is ordinarily provided as an air vent to reduce the effects of pneumatic damping when the contact element is actuated. This hole, or related methods of venting, are commonly employed in existing key-panel fabrications, to reduce the effects of pneumatic damping when domes or diaphragms are actuated. The hole may also be through-hole plated, to serve as a via, providing an electrical connection from a central contact pad associated with a switch made using the switch element in conjunction to conductive tracks on a PCB or other substrate.

Materials used to fabricate the switch element must necessarily be electrically conductive, whether by material property, or additional surface coatings, and may be metallic, although not essentially so. The bearer element will generally, but not essentially so, be made of sheet metal which has different characteristics than the sheet material used to produce the contact element. The bearer element needs to be relatively strong with rigid properties, perhaps typically from about 20 to 100 microns thick. The contact element, a diaphragm or dome, should be highly resilient, of a springy material, perhaps typically about 50 micro-metres thick. The switch element may be of any practical, required dimensions and plan-view shape or footprint. It may range in profile size, when viewed from the edge, from a virtually un-noticeable profile, to a bold profile which can provide tactile relief for purposes of physically defining key-pad locations for human operators of key-panels into which the device is incorporated. The switch element may be smaller or somewhat larger in any or all of its dimensions, and some of its features may be varied to provide specific characteristics.

Figure 6:
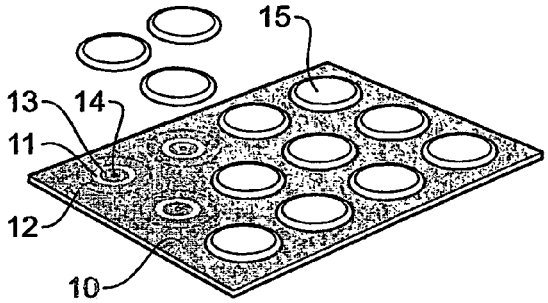
FIG. 6 shows three devices according to the first embodiment of the invention and associated placement positions upon a printed circuit board.

FIG. 6 shows three loose devices and associated placement positions upon a PCB A PCB 10 has a copper foil pattern over most of its upper surface, except for insulating regions formed as etched annular rings 11. These non-conducting rings serve to electrically isolate the outer rim-seating area 12 of each switch location, from the inner, concentric contact pads 13. This printed-circuit pattern is one of a number of possible circuit layouts, and is essentially identical to circuit patterns which may be seen in use for many current key-panel layouts incorporating naked domes as switching elements, using various containment and retention methods. The concentric contact pads 13 each have a connecting via and air-vent 14, to prevent pneumatic damping, as is the practice with other dome-switch lay-ups. A switch element 15, one of a number in this example, is permanently bonded to the PCB substrate.

Figure 7:
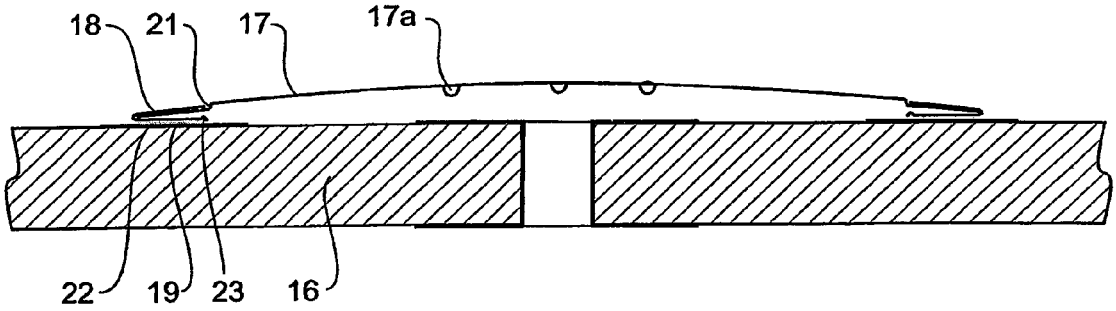
FIG. 7 shows a magnified side-elevation view of an alternative switch element according to the present invention fixed to a substrate.

FIG. 7 shows a magnified, side-elevation view of an alternative switch element according to the present invention fixed to a PCB substrate 16. The switch element, shown in its un-actuated state has a contact element 17 retained by a bearer element 18 with the lower surface of its bearer element bonded at 18 to the outer concentric connection pad 19 on the PCB. This very secure means of mounting is a key feature of the switch element of the present invention The contact element 17 has a step 21 around its rim and the bearer element 18 has a down-turned inner rim 23 on its lower surface 22. This down-turned rim in use can form a barrier against the ingress of soldering fluxes or other residues of the fixing process onto the central region where a contact pad is located.

FIG. 7 also shows dimples 17*a* formed in the contact element 17 to give a more positive contact to a conductive pad on a PCB when the contact element is depressed.

Figure 8:
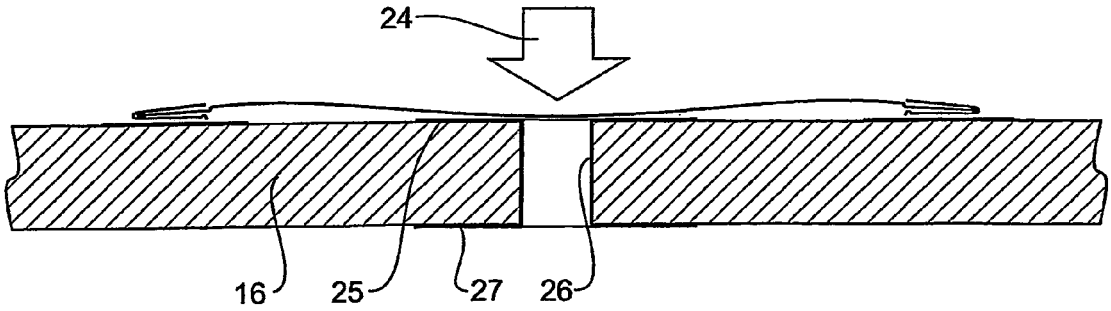
FIG. 8 shows the embodiment shown in FIG. 7 in the depressed state.

FIG. 8 shows the device depicted in FIG. 7 depressed, normally by finger-pressure 24, at its centre. The pressure represented by 19 causes the conductive contact element to electrically contact the central contact pad 25 on the PCB, to the outer contact ring on the PCB. It is this momentary connecting action, maintained as long as mechanical pressure is applied, that serves to provide the functions of a switching device. The characteristics of the contact element provide a mono-stable switching action, when pressure upon the contact element is released, contact should be quickly and cleanly broken. If the contact element is domed in shape, this make and break action will have a very desirable hysteresis or "snap-action". The switch element notably permits a broad range of switching actions, from a "soft-touch", non-snap action, to a very noticeable snap-action which can be quite exaggerated, due to the very strong dome-retaining properties of the switch element. The central contact pad 25 is shown connected through a via 26 which also serves as a vent, to a circuit track 27 on the lower side of the PCB.

Figure 9:
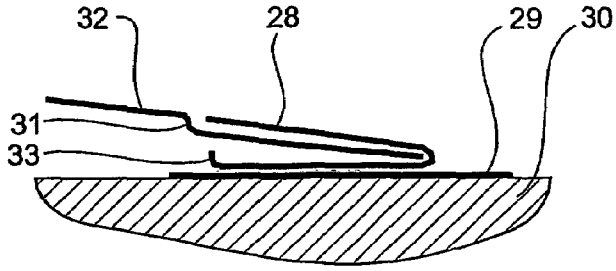
FIG. 9 shows part of a switch element according to an alternative embodiment in a detailed cross section view.

FIG. 9 shows part of a switch element according to an alternative embodiment in a detailed cross section view. The bearer element 28 is bonded to the perimeter contact pad 29 on a PCB 30 by means of solder. A slight step 31 near the perimeter of the contact element 32 is dimensioned so that, in the case where a very discreet profile is required, there is no discernible ridge on the surface of the switch element. A movement-restricting ring 33 is provided on the inner edge of the bearer element 28 in the form of a turned up inner edge of the bearer element and provides a constraining feature of the bearer element, which ensures that the contact element 32, when actuated, can only deform in its desirable mode. In this mode, when the central region of the contact element is brought to bear upon the central contact pad upon a substrate, the restricting-ring 33 prevents the perimeter region of the contact element from being flattened. This in turn assists the contact element in staying, in all cases, within its mono-stable behaviour mode, thus preventing the contact element from "locking-down" and remaining in an actuated state after all actuating pressure is removed, as can happen with naked domes.

Figure 10:
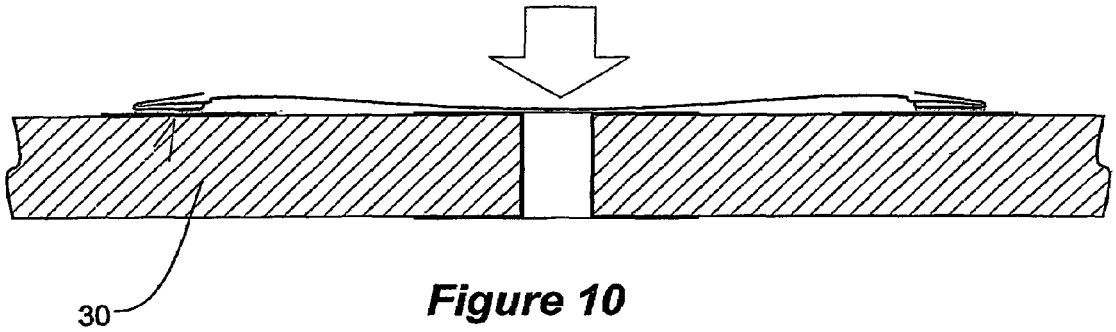
FIG. 10 shows a switch element incorporating the detail of FIG. 9, in an actuated state, due to a deforming pressure being applied to its central region.

FIG. 10 shows a switch element incorporating the detail of FIG. 9, in an actuated state, due to a deforming pressure being applied to its central region.

Figure 11:
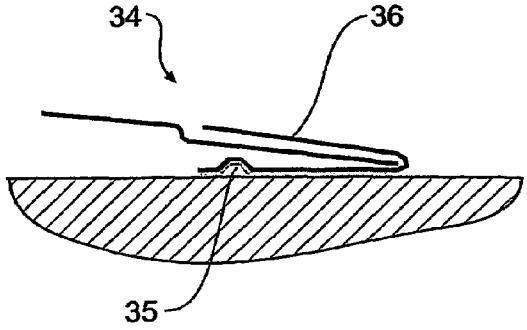
FIG. 11 shows part of a switch element according to an alternative embodiment in a detailed cross section view.

FIG. 11 shows part of a switch element according to an alternative embodiment in a detailed cross section view. In FIG. 11 a switch element 34 incorporates a detent 35 on the bearer element 36. This is another means of providing a restricting-ring, which achieves the same outcome as described with respect to FIG. 9. This detent can be formed as a continuous concentric indentation in the lower surface of the bearer element, or it may be a series of dimples following the same general path as a continuous indentation.

The bearer element ensures that the switch element cannot move laterally, or "migrate" out of position, as can occur in conventional containment systems. It also serves to prevent the rim of the contact element from "flipping" upwards when deforming forces are applied to actuate a switch. The bearer element, in holding captive its contact element, means that the switch element does not need any form of overlay, as a retaining device for the contact element, in order for it to function as a switch, as is required by conventional dome switch systems. However, in many practical situations, an overlay or facia, featuring key-legends or graphic presentation artworks or a facade of moulded keys, may be applied.

Figure 12:
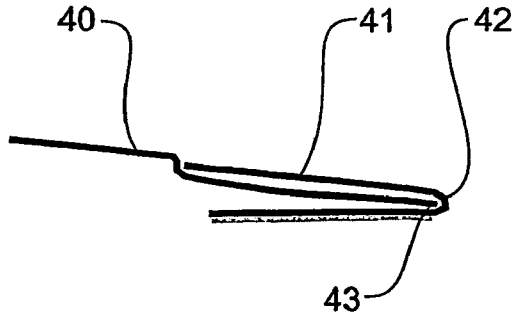
FIG. 12 shows part of a switch element according to an alternative embodiment in a detailed cross section view.
Figure 13:
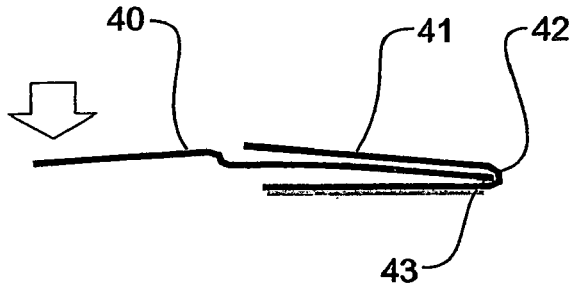
FIG. 13 shows part of a switch element according to an alternative embodiment in a detailed cross section view.
Figure 14:
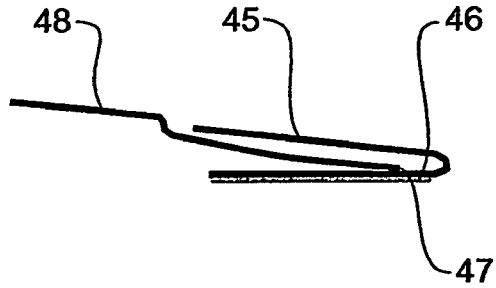
FIG. 14 shows part of a switch element according to an alternative embodiment in a detailed cross section view.
Figure 15:
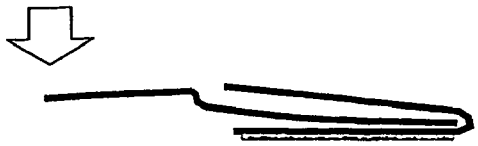
FIG. 15 shows part of a switch element according to an alternative embodiment in a detailed cross section view.

FIGS. 12 to 15 illustrate the means by which in various embodiments the bearer element retains, supports and constrains its associated contact element, according to the features desired for the switch element. Thus, slight variations in the dimensions and the profile form of the bearer element and its companion contact element can be adjusted in small increments to exemplify several modes of operation in the device. FIGS. 12 to 15 show the two basic forms of contact element support. FIGS. 12 and 13 illustrate a "knife-edge" bearing between the contact element and the bearer element. FIGS. 14 and 15 show the bearer element supporting the contact element by means of thrust-bearing surfaces.

FIG. 12 shows the relevant section, in profile, of a switch element in its un-actuated state. The contact element 40 is shown in its un-actuated state, with the edge of its rim 43 lightly constrained by the internal perimeter crease 42 of the bearer element 41. This serves as a knife-edge bearing for the contact element.

FIG. 13 shows the device depicted in FIG. 12 in its actuated state, caused by a deforming force, (finger-pressure), upon the centre area of the switch element. In this case, the deformation of the contact element 40 would have an inherent, slight effect of splaying the rim 43 of the contact element 40 outwards. This slight tendency to outward movement of the dome is constrained by the bearer element 41. This "knife-edge" bearing system means that the dome is never loose, and therefore cannot rattle.

FIG. 14 shows a means of contact element support in the form of a thrust bearing. The internal surface 46 of the bearer element 45 provides a bed upon which the rim 47 of the contact element 48 sits. The unactuated diameter of the dome is slightly less than the maximum internal diameter of the bearer element, such that, when the dome is fully depressed, such actuation causes the contact element 48 to splay outwards until its rim is lightly in contact with the internal crease of the bearer element.

FIG. 15 shows the device depicted in FIG. 14 in its actuated state. In this case, the switch element 48 is fully depressed, and its rim 47 has splayed outward, slightly, to engage the internal crease 46 of the bearer element 45.

Whilst the FIGS. 12 and 13, 14 and 15 illustrate two bearing styles in the switch element, very small adjustments of relative dimensions can provide a bearing action which falls somewhere between a full "knife-edge" and a "full "thrust-bearing". For example, the device might be configured as a thrust-bearing for 50% of the travel caused by dome actuation, upon which the dome-rim engages the internal crease of the bearer element, so that continued progress of dome actuation is constrained by a knife-edge bearing effect. The constraining effect of the bearer element upon the perimeter of the dome may cause a slight accentuation of the hysteresis, or "snap-action" of the dome, a generally desirable outcome. The same constraining effect might serve to reduce any eventual "fraying" effect upon the rim of the dome in the case of a long operational life.

A further, useful outcome of the bearer element's very effective containment of the contact element, is that, in the case of a domed contact element, a somewhat stronger snap-action may be exploited, because the switch element is much more robust than contemporary containment systems, virtually eliminating the opportunities for domes to escape from capture in ordinary circumstances of use.

Figure 16:
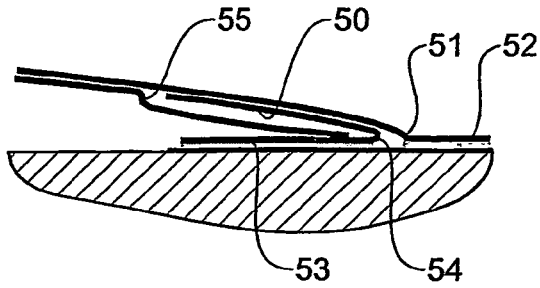
FIG. 16 shows part of a switch element according to an alternative embodiment in a detailed cross section view and affixed to a substrate.

FIG. 16 shows part of a switch element according to an alternative embodiment in a detailed cross section view and affixed to a substrate. FIG. 16 shows that the switch element can be produced so that its profile, in its un-activated state, is virtually indistinguishable from a dome retained by conventional laminated spacer systems. This is achieved by tapering the bearer element 50 to an acute angle at its rim 54, and providing a formed step 55 in the rim of the contact element 56. An optional overlay 51 is added and the overlay could be fastened by adhesive 52.

Figure 17:
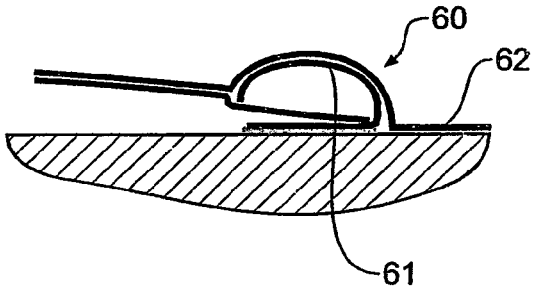
FIG. 17 shows part of a switch element according to an alternative embodiment in a detailed cross section view.

FIG. 17 shows part of a switch element according to an alternative embodiment in a detailed cross section view. FIG. 17 shows the switch element 60 configured with an exaggerated containment lip 61 again with an optional overlay 62. This prominent rim provides a tactile positional cue to human operators of key-panels, often a very desirable feature. Significantly, the prominent rim of the switch element, in this case, provides a very firm support for an overlaid facia. In conventional dome-switch systems, such tactile features can be provided by similar embossed features but such raised features must rely on the rigidity of plastics materials used in the facia. This need for rigid sheet materials conflicts with a need for such materials to also be very compliant to the movements of a domed element. In some cases, such rigidity in an embossed overlay can give rise to an annoying "double-click" when a dome is depressed through its overlaid, embossed facia-dome. Further, such rigid, un-supported tactile prominences are prone to eventual fracture due to brittleness associated with rigidity. The switch element offers very effective support for tactile key-panel features, allowing a more elastic, more compliant overlay materials, for a longer key-panel life-span, free of fractures and "double-clicking" effects.

Figure 18:
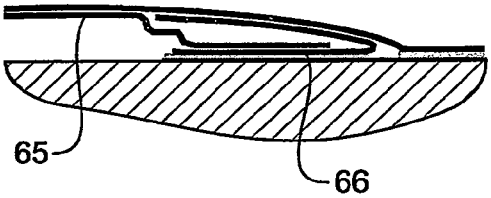
FIG. 18 shows part of a switch element according to an alternative embodiment in a detailed cross section view.

FIG. 18 shows another form of the switch element, where a contact element 65 without a domed structure is incorporated. This serves to provide a quiet, "soft-touch" switching action, if such an action is desirable. A small amount, typically about 100 micrometres, of contact clearance is provided by the thickness of the material in the base of the bearer element 66.

Figure 19:
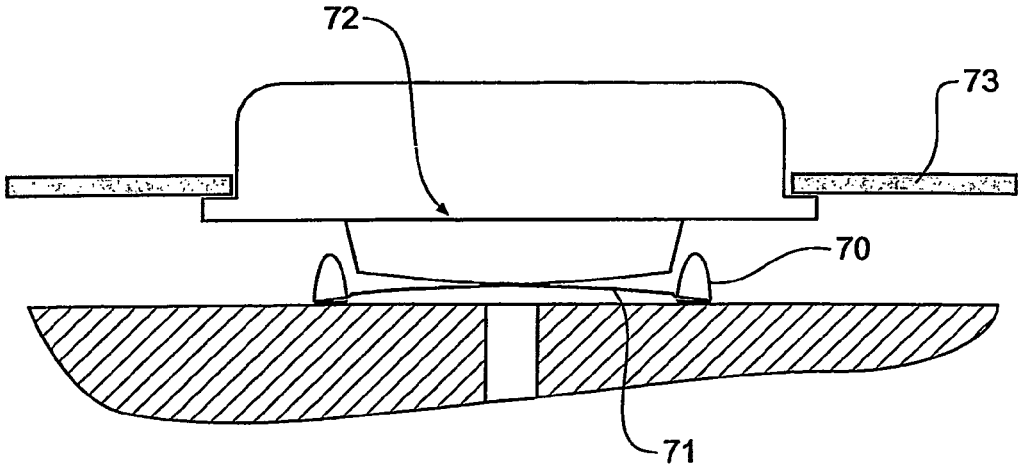
FIG. 19 shows an alternative embodiment of a switch element according to the present invention useful for computer key pads.

FIG. 19 illustrates the concept of a further exaggerated perimeter 70 in the switch element 71, providing a containment-wall around a locating depression into which an actuating button or key-cap 72 can be located, to produce a tactile key-panel with a tailored degree of snap-action. A panel 73 with holes serves to retain the keys. Coupled with the fact that the proposed surface mounting device is conceived for high-speed, fully automated fixing to PCBs or other substrates, this embodiment could, for example, be used in high-volume manufacture of computer keyboards.

Figure 20:
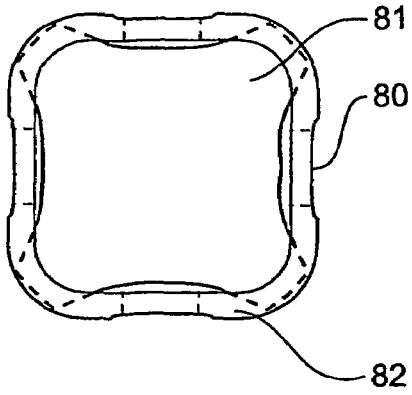
FIG. 20 shows a switch element according to the present invention configured for use with single-sided PCB substrates.
Figure 21:
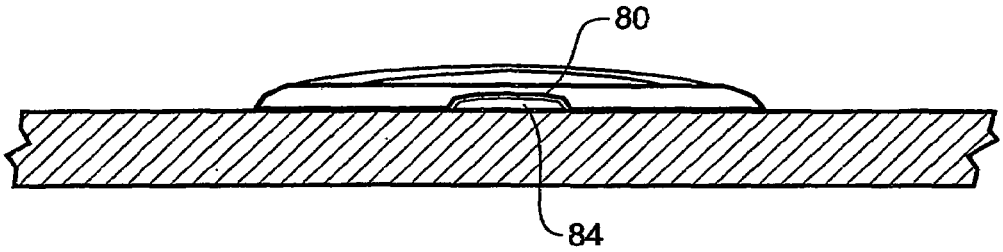
FIG. 21 shows the switch element of FIG. 20 mounted to a PCB.

FIGS. 20 and 21 show a switch element according to the present invention configured for use with single-sided PCB substrates, as sometimes required for high-volume, low-cost manufacturing of key-panels or key-boards. In this mode of construction, where conductive tracks are only available on one side of a PCB, no vias are available on the PCB so connections to central contact pads must be brought out on the same side of the substrate as the switching device is mounted upon, yet without incidentally connecting with the outer perimeter contact and bonding surface of the device. This can be achieved by a bridging structure 80 on the bearer element 82 in conjunction with a multi-legged contact element 81. This permits standard-sized printed tracks on a PCB to run below the device, without contacting any part of its rim. The bridging sections 80 on the switch element shown in FIG. 21, are featured on all four sides of the device shown. The device is shown in a rounded-square plan-form, to provide an indexing feature so that devices may be correctly orientated for placement by automated systems. A means of support 84 for the bridging sections 80 in the form of pads of insulating material, such as plastic, ceramic or other material which can withstand expected process temperatures for the device, could be affixed when the device is manufactured, by adhesive or by formed studs which mate with holes in the bearer element surface to place the insulating supports between the bridging sections and the area of, for example, a PCB.

Figure 22:
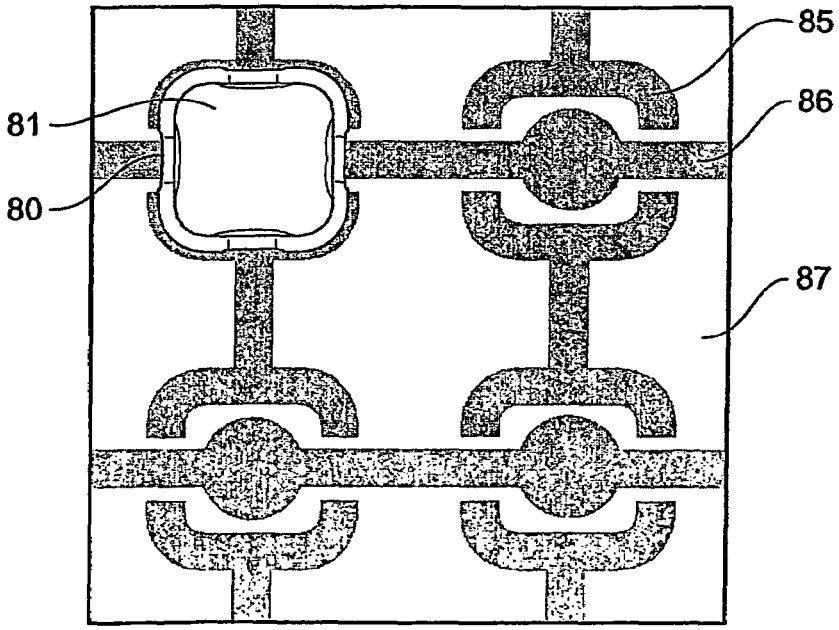
FIG. 22 shows a single sided PCB with a switch element with bridging structures.

FIG. 22 shows a single sided PCB 87 with a switch element with bridging structures according to FIG. 20. The printed circuit pattern shown by tracks 85 and 86 in FIG. 22 are configured in a "row-and-column" matrix, as commonly employed in interfaces between microcomputers and key-panels. The switch element is mounted so that the track 86 passes through the bridge section 80 without electrical contact being made, unless the contact element 81 is deliberately depressed.

FIGS. 23 to 30, inclusive, show various plan forms that are suitable for production as the switch element. Various combinations of shapes and styles of contact elements, including continuous rimmed styles and multi-footed styles are shown. The device may be configured in rounded forms, or polygonal forms featuring straight sides and corners which may be rounded to various degrees. All shapes and styles shown have in common, the essential features of the switch element. These shapes may be used where a product designer, for instance desires a particular layout on a facia.

Figure 23:
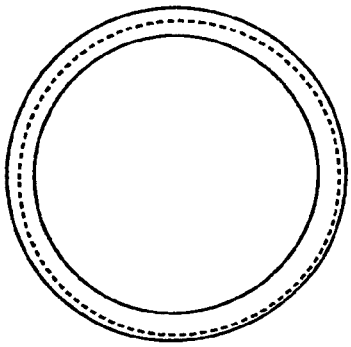
FIGS. 23 to 30 show various plan forms that are suitable for production as a switch element according to the present invention.

FIG. 23 is in the form of both a circular contact element and circular bearer element.

Figure 24:
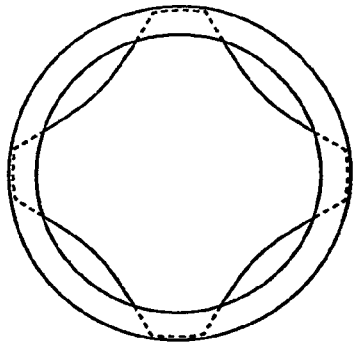

FIG. 24 is in the form of a four legged contact element within a circular bearer element.

Figure 25:
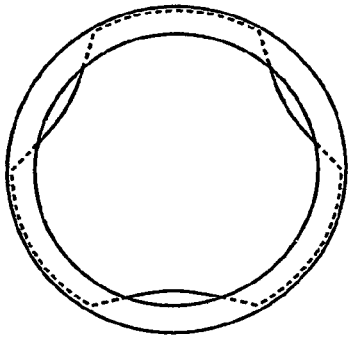

FIG. 25 is in the form of a three wide legged contact element within a circular bearer element.

Figure 26:
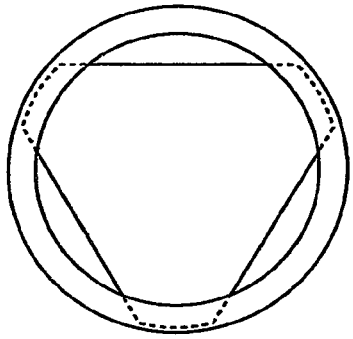

FIG. 26 is in the form of a three narrower legged contact element within a circular bearer element.

Figure 27:
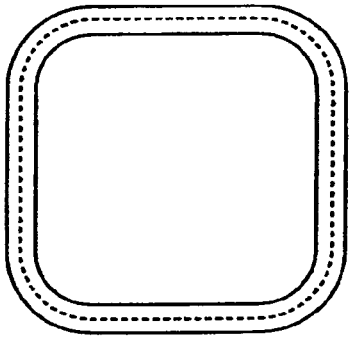

FIG. 27 is in the form of a square with rounded corner bearer element with a square with rounded corner contact element.

Figure 28:
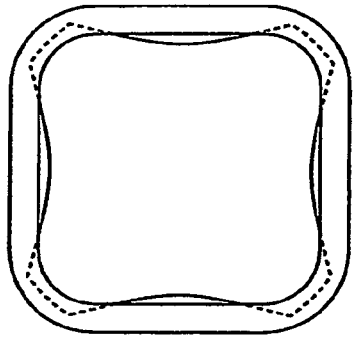

FIG. 28 is in the form of a square with rounded corner bearer element with a four legged corner contact element.

Figure 29:
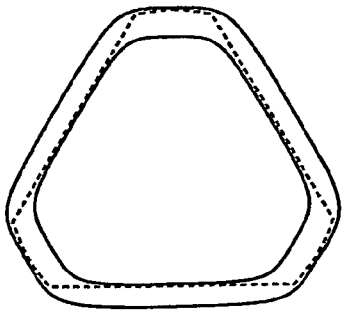

FIG. 29 is in the form of a triangular with rounded corner bearer element with a triangular with rounded corner contact element.

FIG. 29 is in the form of a triangular with rounded corner bearer element with a triangular with three legged corner contact element.

Figure 30:
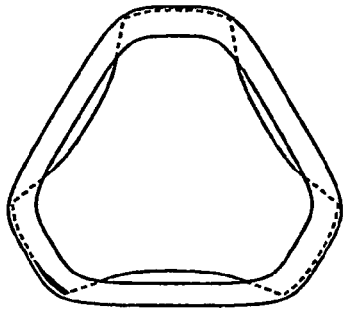

The triangular switch elements shown in FIGS. 29 and 30 may be used as arrowheads.

Figure 31:
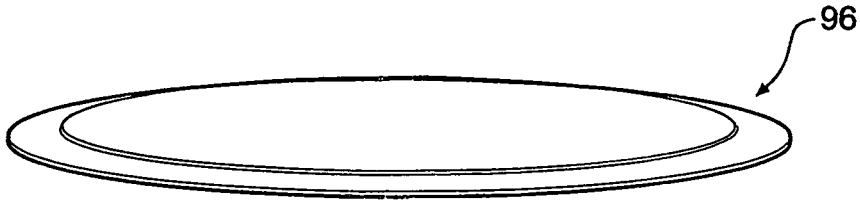
FIGS. 31 and 31A show an alternative embodiment of switch element according to the present invention mounted to a printed circuit board.
Figure 31A:
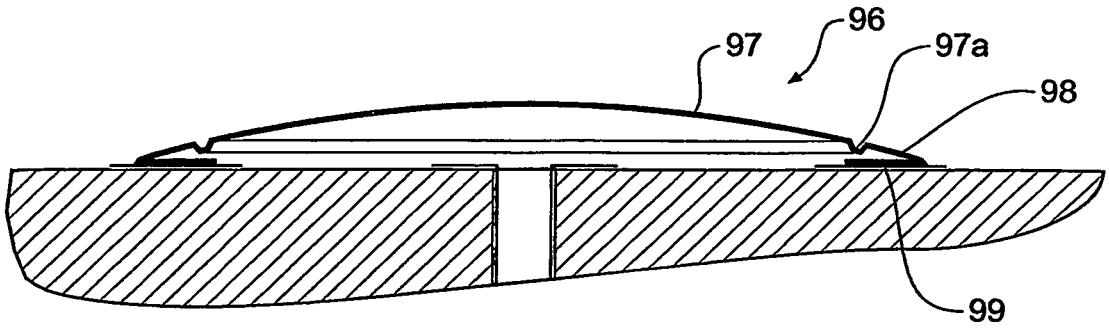

FIGS. 31 and 31A show an alternative embodiment of the switch element of the present invention. This switch element 96 is formed with a contact element portion 97 and a bearer element portion 98 formed from one piece of sheet material, with a rim 99 folded under the domed section to provide a mounting base. The domed section takes a convoluted form with a circumferential groove 97*a* to permit a small degree of flexibility.

Figure 32:
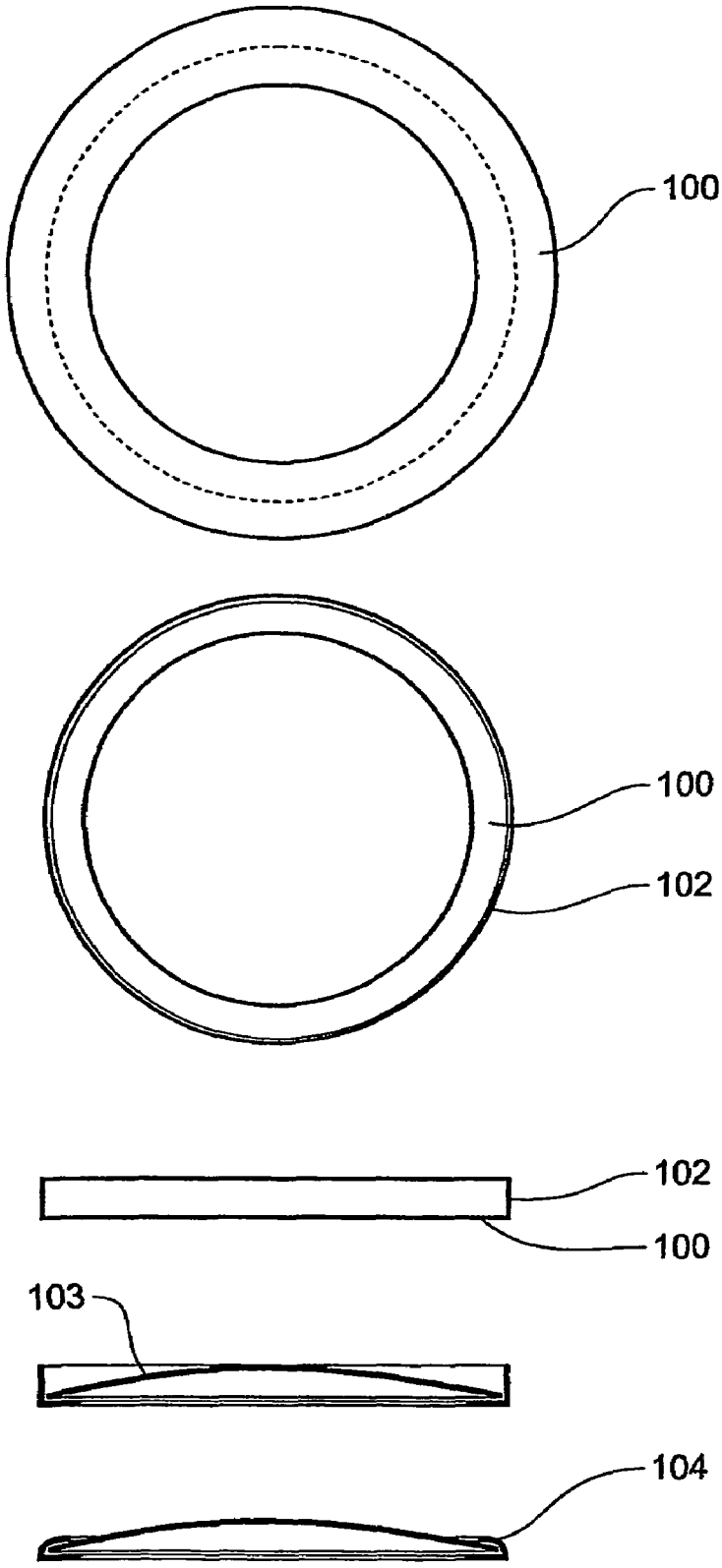
FIG. 32 shows one method by which a switch element according to the present invention may be fabricated.
Figure 33:
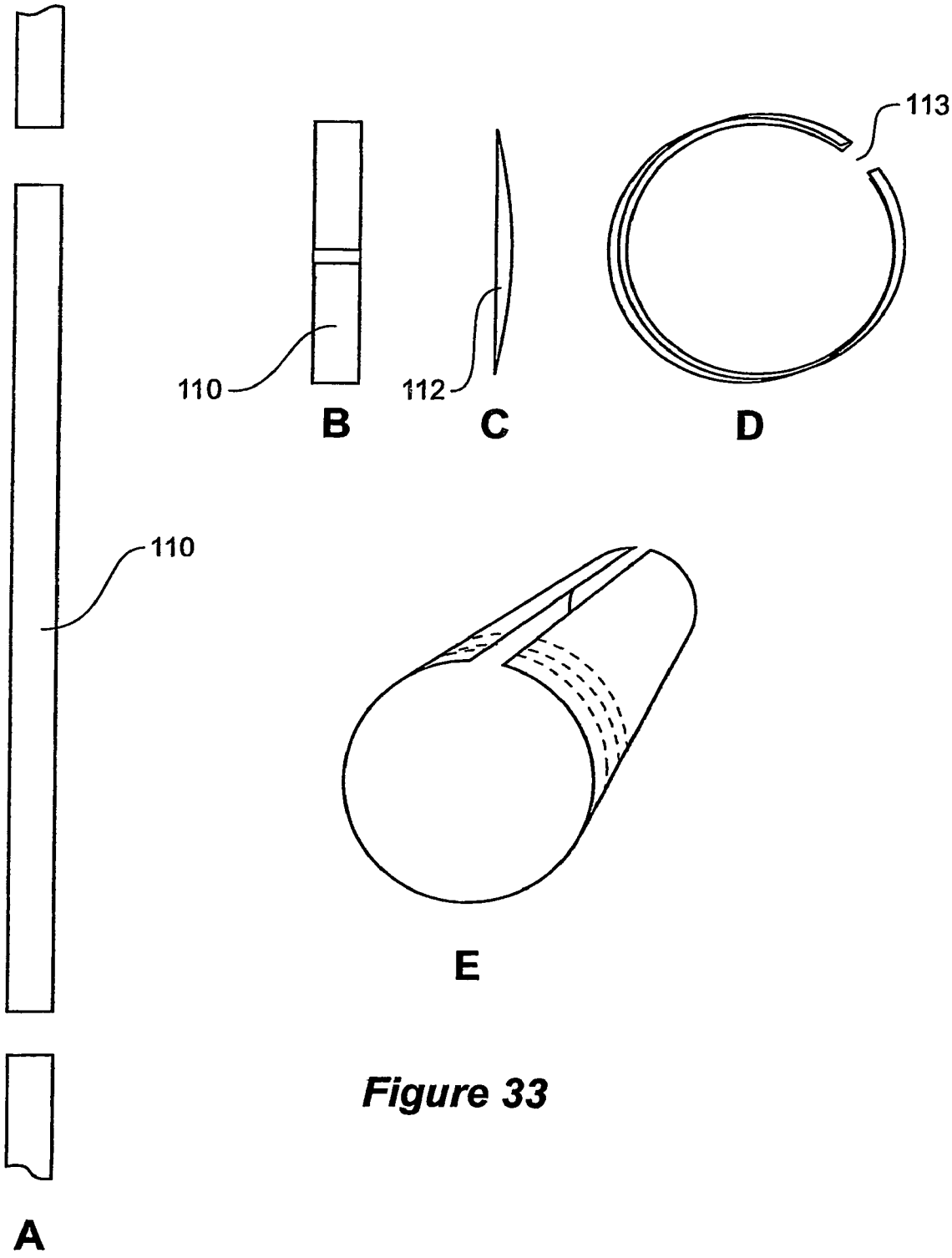
FIG. 33 shows an alternative embodiment by which a switch element according to the present invention may be fabricated.

Some possible methods of fabricating the switch element are shown in FIGS. 32 and 33.

FIG. 32 depicts one basic method of manufacture, greatly simplified, of the switch element. An annular ring 100 can be die-cut from sheet-metal. Next the die-cut ring 100 is partially formed along the fold-line 101 to give a folded up edge 102. Next a contact element 103 is placed into the formed bearer element 104 and the edge 102 folded over to encapsulate the contact element and to give the final product. Such a method of manufacture will produce a high-quality result, from relatively simple tooling although with some wastage of materials, such as the disc that is punched out of the centre of the bearer element. This waste could be offset by punching progressively larger blanks from a prepared, surfaced sheet of metal. All waste metal could be re-cycled, meaning that the main wastage of this production system would be lost energy. One outcome of this production method is that the bearer element will feature a continuous perimeter, without gaps or seams. It is relatively simple to tool up to press and form the bearer elements. The contact elements 103, adaptations of existing domed devices, would be produced by existing volume-production methods.

FIG. 33 shows some stages of another method of manufacture of the switch element. This method, while more complex in its tooling requirements, also will produce very little waste, where waste may be a significant cost in the manufacture of devices such as these.

Drawing A shows a strip 110 cut from a roll of prepared sheet-metal. The length of this strip suits the circumference of the bearer element it is to produce. The metal strip is then rolled as shown by drawing B into a ring and then and formed by hardened pinch-rollers into the basic ring form 111 of a bearer element as shown at drawing D, although at this stage, the ring 111 features an opened gap 113 which increases the overall diameter of the element, so that a contact element 112 shown in drawing C can be positioned in the internal plane of the bearer element. The assembly is then rolled into a closed position so that there is a negligible gap between the two ends of the bearer element material. This gap could be dosed by fusion-welding, but this is not essential. When the completed device is mounted, whether by surface-mount soldering, or fusion welding to a substrate PCB, the gap will be of little consequence, as long as the material it is made from is strong enough to resist crushing in ordinarily expected circumstances of end-product use. A variation of this fabrication method would cause a continuous strip of suitable material to be formed in to a continuous coil, single sections of which would be nipped off, by a straight or compound-edge tool, to form "C" sections ready for insertion of contact elements prior to closing. Such bearer elements as formed this way would be slightly twisted by dint of having been cut from a continuous coiled feedstock, but this distortion could be corrected by the forming tool which doses the bearer element about the contact element.

Drawing E shows that blanks for the bearer elements could be cut from a formed tube which may, if desired, be seamlessly fusion-welded or be left with an open slit which would be closed later in the process.

Throughout this specification various indications have been given as to the scope of this invention but the invention is not limited to any one of these but may reside in two or more of these combined together. The examples are given for illustration only and not for limitation. Throughout this specification and the claims that follow unless the context requires otherwise, the words 'comprise' and 'include' and variations such as 'comprising' and 'including' will be understood to imply the inclusion of a stated integer or group of integers but not the exclusion of any other integer or group of integers.

The claims defining the invention are as follows:

1. A switch element for surface mounting onto a printed circuit board, the switch element having a bearer element and a contact element, both the bearer element and the contact element being formed from an electrically conductive material and the contact element being formed from a resilient material, wherein the bearer element comprises an inwardly facing C-shaped cross sectional shape to provide a recess to act as a peripheral retainer for the contact element by receiving at least a portion of a rim of the contact element in the C-shaped member recess.

2. A switch element as in claim 1 wherein the bearer element and the contact element are separate components assembled together.

3. A switch element as in claim 1 wherein the contact element is a shallow dome shape.

4. A switch element as in claim 3 wherein the contact element comprises at least one dimple at or close to the centre of the dome.

5. A switch element as in claim 1 wherein the bearer element comprises a peripheral retainer for the contact element.

6. A switch element as in claim 1 wherein the bearer element comprises a substantially planar base to enable it to be affixed to a conductive track on a printed circuit board.

7. A switch element as in claim 6 wherein the substantially planar base comprises a solder paste to assist with soldering the switch element to a printed circuit board.

8. A switch element as in claim 6 wherein the planar base comprises an inner periphery with a slight downwards angle to contact a printed circuit board in use and form a barrier against the ingress of soldering fluxes or other residues of a fixing process.

9. A switch element as in claim 6 wherein the planar base comprises an inner periphery with a slight upturned edge.

10. A switch element as in claim 1 wherein the bearer element comprises at least one bridge around its periphery to enable the bearer element to bridge tracks on the printed circuit board onto which it is mounted in use.

11. A switch element as in claim 1 wherein the bearer element comprises a shape selected from the group comprising circular, square, rectangular or triangular and the contact element received in the bearer element comprises a corresponding shape either with a continuous periphery or with legs extending into the recess of the bearer element.

* * * * *